US010214870B2

(12) United States Patent
Jansen et al.

(10) Patent No.: US 10,214,870 B2
(45) Date of Patent: Feb. 26, 2019

(54) BUOYANCY COMPENSATED EROSION CONTROL MODULE

(71) Applicants: Grant Jansen, Bellingham, WA (US); Austin Huang, Bellinghamd, WA (US)

(72) Inventors: Grant Jansen, Bellingham, WA (US); Austin Huang, Bellinghamd, WA (US)

( * ) Notice: Subject to any disclaimer, the term of this patent is extended or adjusted under 35 U.S.C. 154(b) by 473 days.

(21) Appl. No.: 14/211,967

(22) Filed: Mar. 14, 2014

(65) Prior Publication Data

US 2014/0369755 A1 Dec. 18, 2014

Related U.S. Application Data

(60) Provisional application No. 61/794,181, filed on Mar. 15, 2013.

(51) Int. Cl.
*E02B 3/04* (2006.01)

(52) U.S. Cl.
CPC ..... *E02B 3/04* (2013.01)

(58) Field of Classification Search
USPC ..... 405/15, 16, 21, 26
See application file for complete search history.

(56) References Cited

U.S. PATENT DOCUMENTS

| | | | | |
|---|---|---|---|---|
| 4,367,978 | A * | 1/1983 | Schaaf et al. | 405/30 |
| 2002/0025221 | A1* | 2/2002 | Johnson | E01F 15/086 404/6 |
| 2003/0185629 | A1* | 10/2003 | Yodock et al. | 405/63 |
| 2009/0110484 | A1* | 4/2009 | Fillingame et al. | 405/26 |
| 2009/0238645 | A1* | 9/2009 | Aristaghes et al. | 405/21 |
| 2009/0304448 | A1* | 12/2009 | Ovretveit | 405/26 |
| 2011/0236132 | A1* | 9/2011 | Wisegerber et al. | 405/30 |
| 2014/0369756 | A1* | 12/2014 | Minton | 405/31 |

* cited by examiner

*Primary Examiner* — Kyle Armstrong
(74) *Attorney, Agent, or Firm* — Forrest Law Office, P.C.

(57) ABSTRACT

Buoyancy compensated erosion control modules and systems are provided. One embodiment includes a shell having at least one wall oriented at an off-vertical angle, a substantially enclosed inner cavity, the inner cavity at least partially filled with a foam core, a perimeter footing at the bottom of the shell, the perimeter footing having a lower cavity that is open on the bottom, at least one vertical pile sleeve and at least one battered pile sleeve, and at least one connector to couple the module to a second module.

12 Claims, 8 Drawing Sheets

BUOYANCY COMPENSATED EROSION CONTROL MODULE

RELATED APPLICATIONS

This application claims the benefit of U.S. Provisional Application No. 61/794,181, filed Mar. 15, 2013.

BACKGROUND

Erosion is a common problem along waterways including ocean shores, river beds, lake shores, etc. This is particularly true for shores with poor load bearing soils, such as soils with high organic content, as long term settlement lowers the utility of current retaining walls and shoreline protection systems.

Current approaches for erosion control include earth retaining walls, heavy systems with large pile foundation support, and floating breakwater systems. Earthen retaining walls are subject to considerable erosion and typically settle readily and therefore require high frequency maintenance.

The materials to build earthen retaining walls are relatively inexpensive, but the high frequency maintenance increases costs considerably. Heavy systems with large pile foundation support are greatly protected from settlement, but the cost of driving large piles deep enough and the cost of the heavy systems have a very high initial cost. Floating breakwater systems do not provide as much erosion control as other approaches as they transfer some wave action and also allow currents and water flow underneath the system, in turn allowing erosion of shoreline and off-shore soils, sand, and supporting ground generally.

SUMMARY

Buoyancy compensated erosion control modules and systems are provided. For example, one disclosed embodiment provides One embodiment includes a shell having at least one wall oriented at an off-vertical angle, a substantially enclosed inner cavity, the inner cavity at least partially filled with a foam core, a perimeter footing at the bottom of the shell, the perimeter footing having a lower cavity that is open on the bottom, at least one vertical pile sleeve and at least one battered pile sleeve, and at least one connector to couple the module to a second module.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
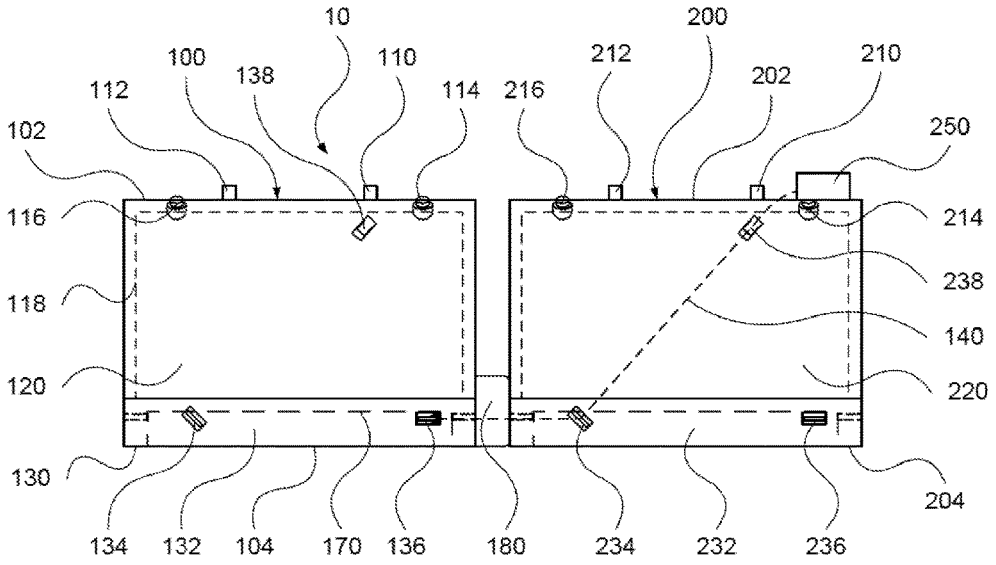
FIG. 1 is a side view of a system of two interconnected erosion control modules according to an embodiment of the present invention.

FIG. 1 is a side view of a system 10 of interconnected buoyancy compensated erosion control modules. In general, an erosion control system may use relatively lightweight buoyancy compensated modular units to achieve a near weightless state after installation in water. When the modular units are neutrally or nearly buoyant, a pile support system can be utilized that primarily supports wave forces on the erosion control system and without having the piles substantially support the weight of the modules within the system, thereby significantly reducing concerns of long term settlement in the poor load bearing organic soils.

A buoyancy compensated system allows use of small piling systems, such as pin piles, allowing installation with smaller equipment and therefore being less constrained by access for large pile drivers, barges, etc., as well as not requiring dredging, land access, or other limitations of conventional erosion barriers. This also allows an erosion control system close enough to a bank line to substantially reduce wave regeneration behind an erosion barrier or gaps at the end of the barrier to prevent oblique angle waves from propagating behind the erosion barrier.

With reference to FIG. 1, buoyancy compensated erosion control system 10 includes a first buoyancy compensated erosion control module 100 and a second buoyancy compensated erosion control module 200 separated by a rubber bumper 180. By way of example, module 100 and module 200 may be lightweight pre-cast concrete modular units with a foam core. In a preferred embodiment, type V cement may be used, however other suitable cements for a marine environment may be used. In the embodiment illustrated in FIG. 1, the units will be supported by advanced pin pile support system having vertical and battered piles and will be linked together to form an effective barrier that will reduce wave action from reaching and eroding a shoreline.

Referring to module 100 in system 10, a precast concrete modular unit (module 100) can include a shell 118 of four-inch thick 3500 psi concrete mix suitable for consistent immersion in ocean water. Additionally, industry recognized and approved admixtures affecting corrosion and chemical resistance, set time, flowability, and/or waterproofing may be used provided the strength and durability of the concrete is not adversely affected. Embodiments are not so limited and may comprise other materials similarly suitable for buoyancy compensation and longevity in a water or salt water environment.

Shell 118 includes at least one cavity 120 which may be filled with a core and may be filled from sidewall to sidewall and operate as a float for module 100. In one embodiment, expanded polystyrene core foam may be used to fill the cavity, such as a closed-cell corrosion proof, expanded rigid cellular polystyrene foam in accordance with ASTM C578, or other similarly suitable materials. In an alternate embodiment, air pockets or other suitable materials may provide buoyancy compensation other than expanded polystyrene core foam. In one example embodiment, the expanded polystyrene core foam may have a minimum compressive strength for example 2000 pounds per square foot and an approximate weight of 3 pounds per cubic foot, however other materials having more or less compressive strength and approximate weight may also be used to provide sufficient compensated buoyancy.

Figure 15:
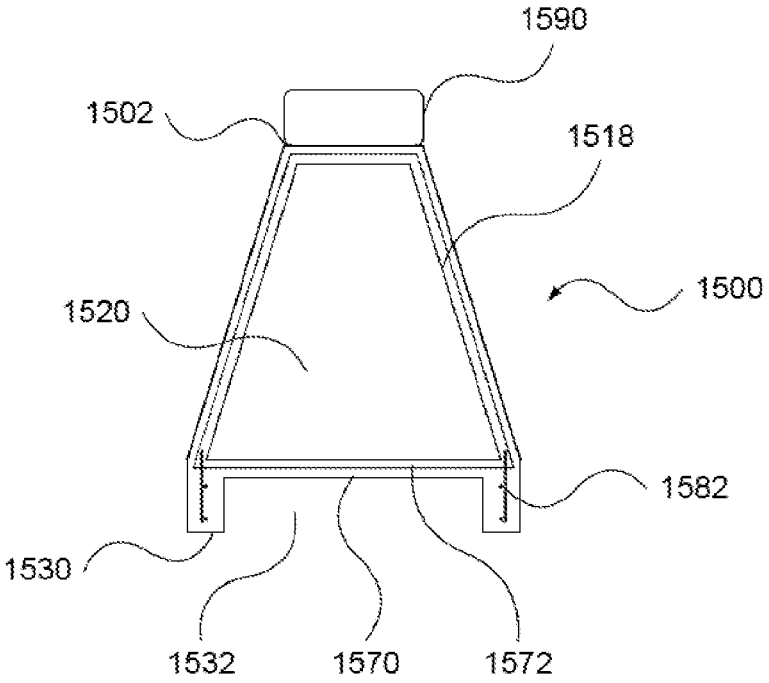
FIG. 15 is an end view of an erosion control module showing rebar, reinforcing mesh and a media basket for vegetation.
Figure 16:
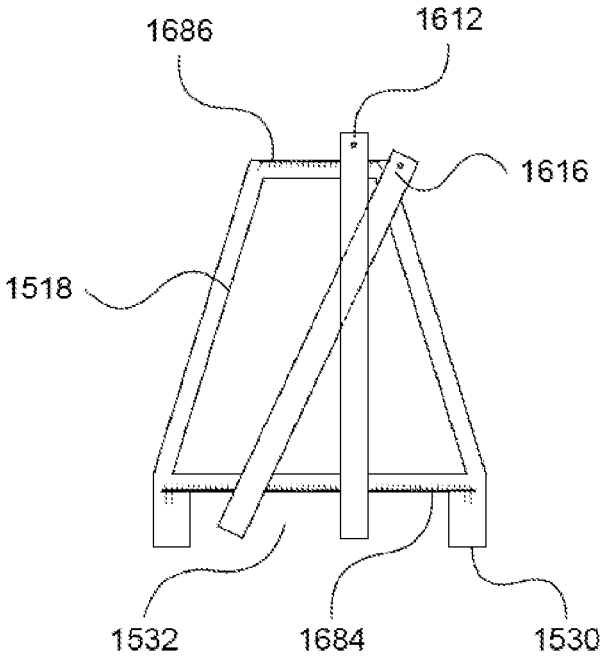
FIG. 16 is an end view of an erosion control module showing vertical and battered pin pile sleeves and steel plate embeds.
Figure 17:
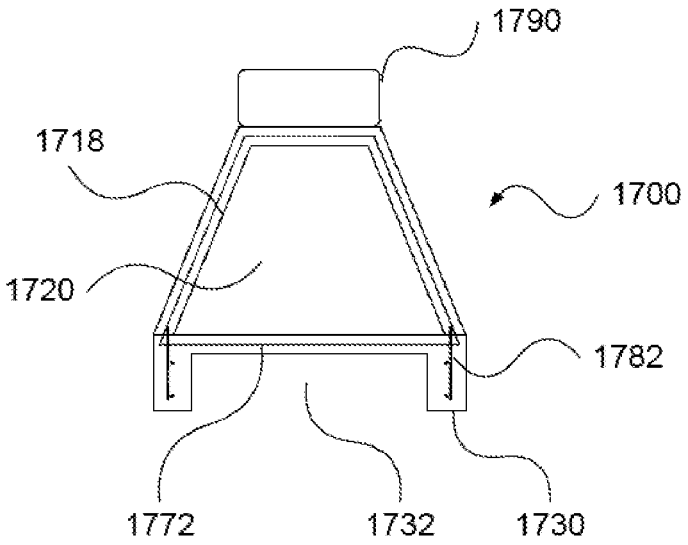
FIG. 17 is an end view of an erosion control module showing rebar, reinforcing mesh and a media basket.
Figure 18:
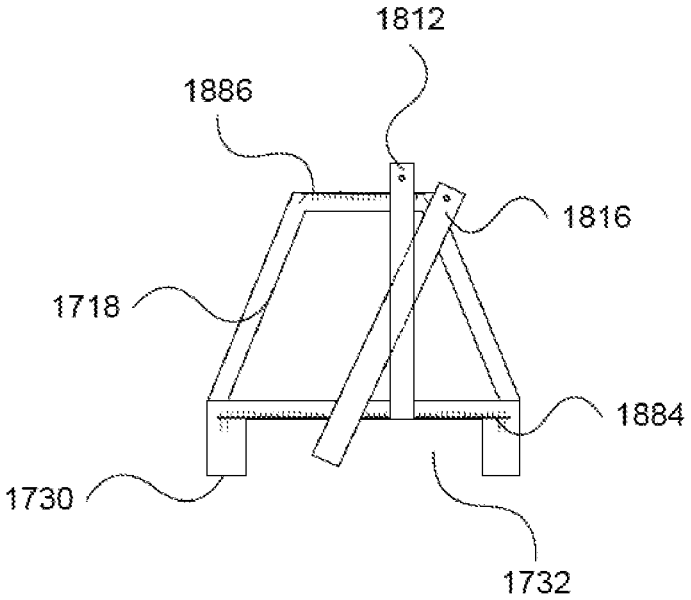
FIG. 18 is an end view of an erosion control module showing vertical and battered pin pile sleeves and steel plate embeds.

With reference to FIGS. 15-18, shells 1518 and 1718 (similar to shell 118) may also include concrete reinforcing, such as reinforcing bars 1582 and 1782 and welded wire fabric (WWF) 1572 and 1772 respectively. In one example reinforcing bars 1582 (rebar) may be grade 60 (Fy=60 ksi) or suitably equivalent, and may also be epoxy coated unless otherwise specified. Example welded wire fabric may be W5, 2"×2", and epoxy coated, in accordance with ASTM A-185. Other similarly suitable welded wire fabric, other fabrics, reinforcing mesh or other reinforcements may also be used. Additionally, in FIG. 16 and FIG. 18, may have steel plate embeds 1684, 1686, 1884 and 1886, respectively, to provide structural strength, distribute forces from the pile sleeves over a larger section of the modules, etc. FIG. 15 and FIG. 17 illustrate an embodiment with a media basket, such as media basket 1590 and media basket 1790 that may be used to hold vegetation or other matter on top of the respective modules.

Module 100 includes pin pile sleeve 110 and pin pile sleeve 112 situated in a vertical or substantially vertical orientation, and battered pile sleeves 116 and 114 configured in a non-vertical orientation. As the modules are buoyancy balanced while installed, there is a reduced need for piles to provide vertical support to one or more modules. In this way, smaller pin piles may be used instead of large conventional piles, reducing material and labor costs and increasing the potential installation locations for embodiment erosion control modules. The use of battered piles that are inserted in pile sleeves 114 and 116 work in concert with the perimeter footing on the bottom of module 100 to combat lateral forces due to wave and wind action. This also allows use of lighter blocks and easier to install piles such as pin piles.

In an example embodiment the sleeve may be a six-inch SCH 40 steel pipe, coated for consistent exposure to a marine environment. In this example embodiment, module 100 and module 200 may have plates and connection ears comprising ⅜ inch steel plates coated for consistent exposure to a marine environment. Each module may also have one or more events per module for example module one may have four cast 2 inch PVC vents, but other embodiments are not so limited.

In some embodiments, pin pile sleeve 110 and pile sleeve 112 and battered pile sleeves 114 and 116 may receive pin piles to secure the module to ground. Example suitable pin piles include four-inch schedule 40 steel pipe and piles with 4000 lb capacity connectors coated for consistent immersion in ocean water. However, other dimension pin piles or non-coated pin piles of a durable material may be used.

Module 100 further includes a perimeter footing 130 surrounding a lower cavity 132 from the bottom 104 of module 100 to the lower cavity top 170. Perimeter footing 130 and lower cavity 132 allow module 100 to settle upon installation and prevent bottom scour. Once the lower cavity top 170 contacts the soil or mud line, module 100 will be substantially settled. In this way, module 100 is installed with a perimeter footing embedded into the soil to prevent base scour or undermining of the foundation and also to utilize soil shear strength to resist sliding from wave forces. Friction between lower cavity top 170 and sub grade soils adds additional lateral resistance sliding.

Vertical pin piles are then driven on the seaward side of the structure to provide support vertical compression and uplift forces and resist overturning. Sloped side face of the structure is designed to direct wave forces at a sub vertical angle that puts the landward battered piles into compression providing the main support against wave action. In general, installation of an erosion control system must take into consideration vertical compression, vertical uplift and lateral forces from wave action.

The current embodiment utilizes pin piles for direct support of the wall system, it reduces the weight of the wall system by using a light weight material in the cavities of modules (foam core), and by utilizing buoyancy compensation for an underwater system it can reduce the vertical compression load from the wall system through the piles and the supporting ground. In this way a buoyancy compensated erosion control system 10 can significantly reduce the system from settling due to soft soil conditions since the modules only sink enough into the subgrade soils for secure placement without having the substantial weight of a non-buoyancy balanced system contributing to subgrade soil erosion.

Figure 2:
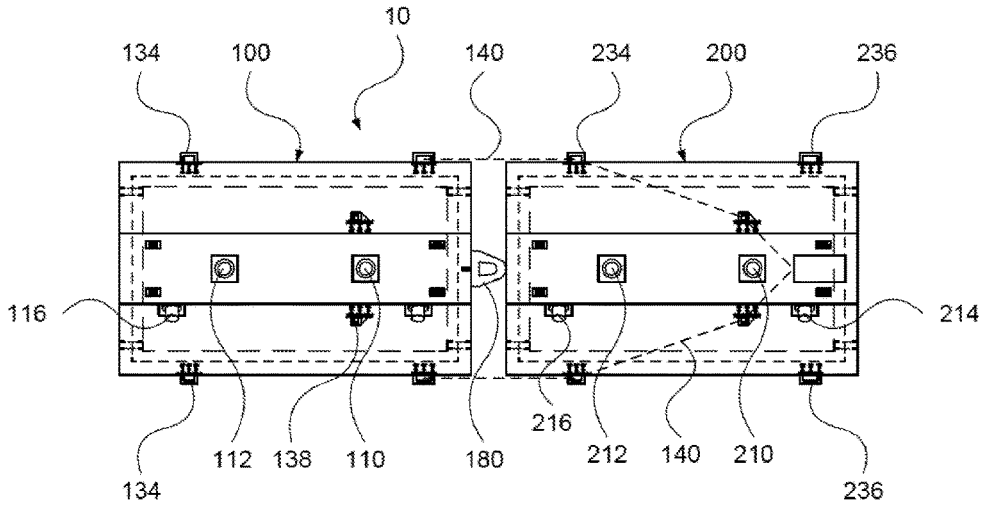
FIG. 2 is a top view of the system of two interconnected erosion control modules show in FIG. 1.
Figure 3:
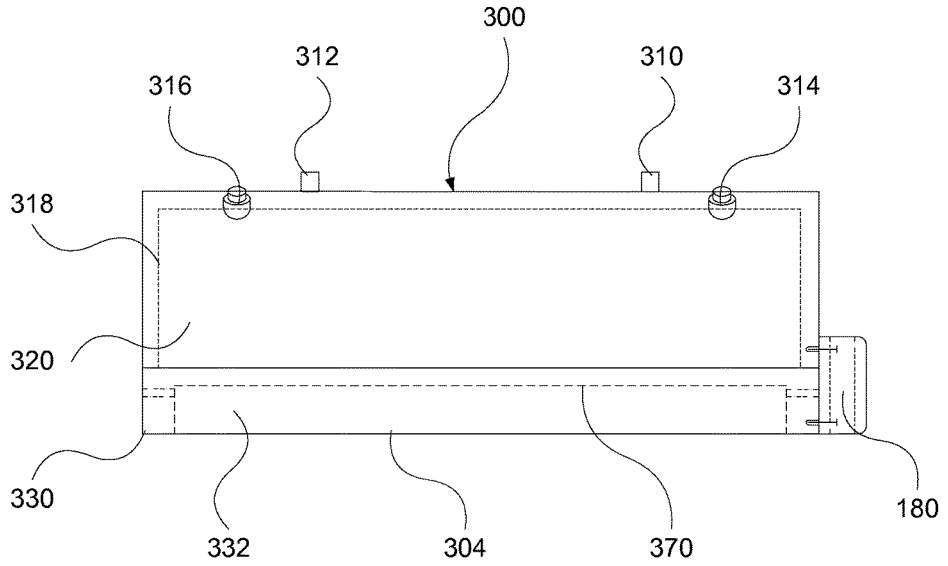
FIG. 3 is a side view of an erosion control module according to an embodiment of the present invention.
Figure 5:
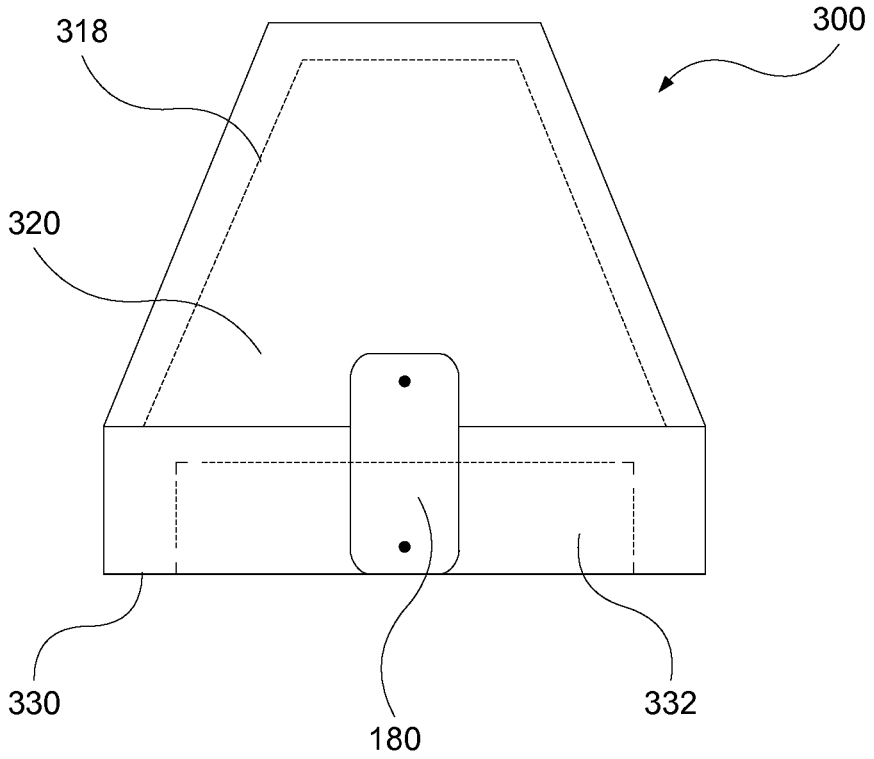
FIG. 5 is an end view of an erosion control module according to an embodiment of the present invention.

With reference to FIGS. 3 and 5, an embodiment module 300 is shown in simplified format from multiple views to better illustrate the shape of an embodiment module. FIG. 3 is a side view of an erosion control module 300 including shell 318, cavity 320, battered pile sleeves 314 and 316, pin pile sleeves 310 and 312, bottom 304, lower cavity top 370, lower cavity 332, footing 330, and rubber bumper 180, similar to module 100 in FIGS. 1-2. FIG. 5 is an end view of module 300, illustrating the non-vertical side shell 318, cavity 320, footing 330 and lower cavity 332. While module 300 is depicted in FIG. 5 with similar sub-vertical side walls, other embodiments may have non-symmetric sidewalls, one or more sidewalls in a vertical arrangement, sidewalls with a non-planar shape, etc.

During installation, buoyancy forces also effectively reduce the weight of the structure as it is submerged so that the piles are used primarily to support the loads from wave action. In some embodiments, the system may be configured so that it will become buoyant or float to resist long-term settlement and maintain a top elevation is still prevents waves breaking over the top of module 100, module 200, etc. In this way, the lightweight design of the system will counter settling due to soft soil conditions. Further, by having a sub-vertical wall of the modules facing seaward, along with using battered piles and buoyancy compensation, the system 10 may be supported with small piles such as pin piles because the piles can be used primarily to resist wave forces rather than support the structure.

With reference to FIG. 2, module 100 further includes an anchor 136, a guide 134, and a cable clamp 138. In FIG. 1, system 10 includes a module 200 constructed similarly to module 100. Module 100 is connected to module 200 by a cable connection system using cable 140, anchor 136, guide 134 and cable clamp 138. In this embodiment, a cable connection may employ 2 cables on either side of a module and may connect the module to the next modular unit creating a train of units.

Figure 4:
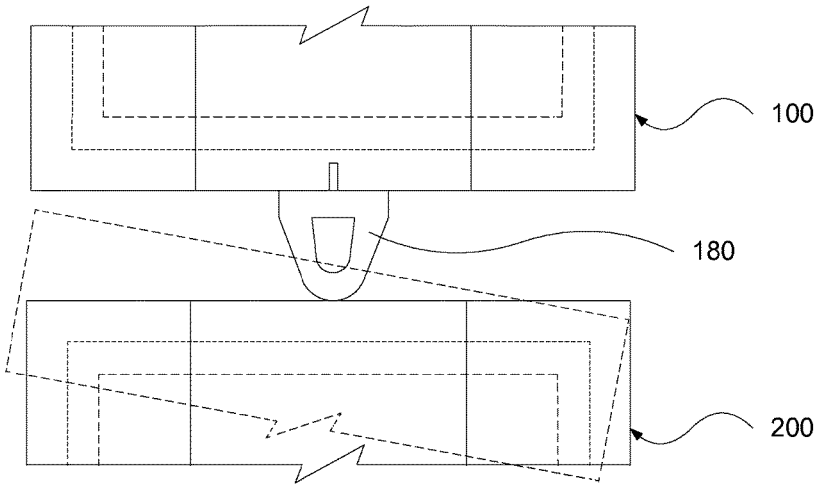
FIG. 4 is a top view of a rubber bumper between two interconnected erosion control modules.

For example, a cable may be attached to anchor 136 of module 100 and fed through guide 234 of module 200 up to cable clamp 238. FIG. 4 illustrates module 100 and module 200 just touching without deformation of rubber bumper 180. As the modules are tightened together using cable 140, rubber bumper 180 deforms. FIG. 4 also depicts module 200 being in a non-parallel orientation with respect to module 100. With use of a cable connection system and a rubber bumper 180, the modules may maintain sufficient erosion control and be placed in a non-linear arrangement.

Figure 6:
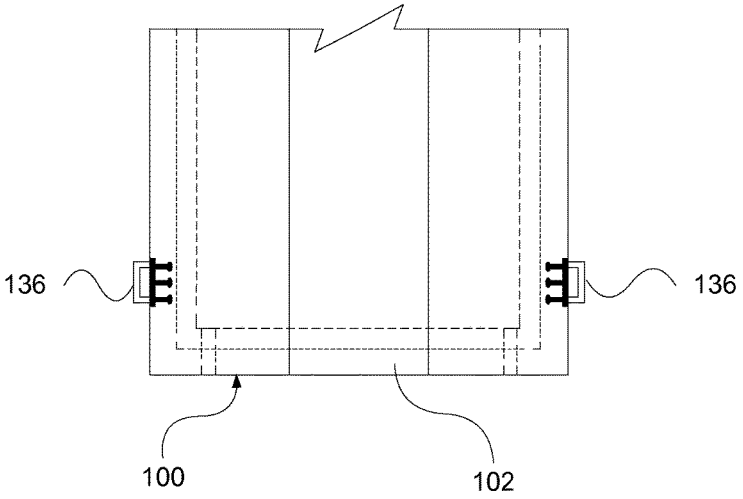
FIG. 6 is a top section view of an erosion control module showing an anchor for coupling modules.
Figure 7:
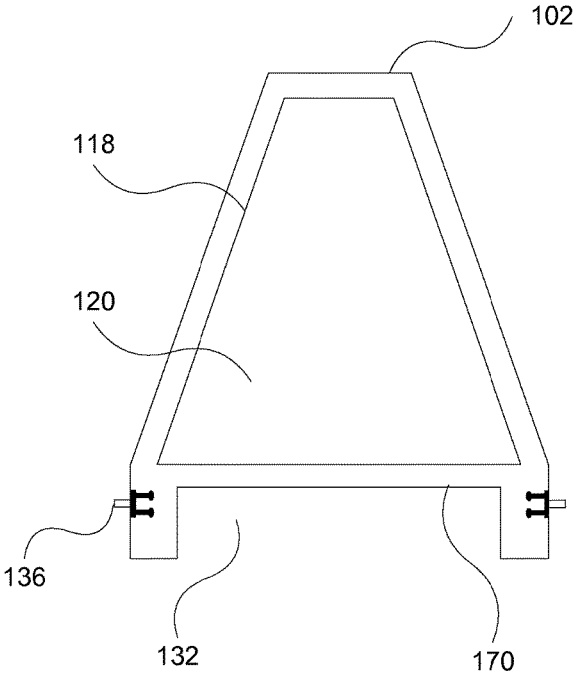
FIG. 7 is an end view of an erosion control module showing an anchor for coupling modules.
Figure 8:
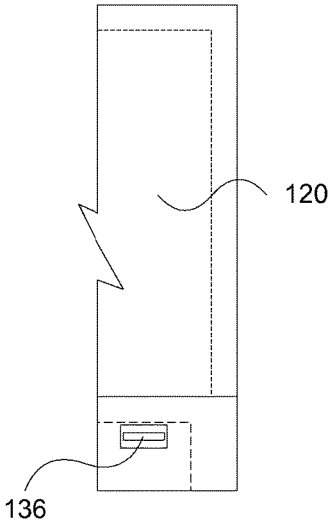
FIG. 8 is a side section view of an erosion control module showing an anchor for coupling modules.

FIGS. 6-14 include modules with guides, anchors and clamps shown in simplified form. FIG. 6 is a top section view of an erosion control module 100 showing an anchor 136 for coupling modules. The orientation of anchor 136 is substantially horizontal and parallel to the perimeter footing of module 100. In this way it can undergo the highest stresses as an anchoring point to pull module 100 into module 200. Additionally, FIG. 7 is an end view of an erosion control module showing anchor 136. The end view also shows the orientation shown in FIG. 6, whereby anchor studs of anchor 136 are placed linearly and substantially parallel with the bottom edge of the perimeter footing of module 100. FIG. 7 also depicts the bottom cavity 132 and the bottom cavity top 170, as well as the top 102 of module 100. FIG. 8 is a side section view of an erosion control module showing anchor 136 for coupling modules 100 and 200.

In the illustrated embodiment, an anchor with anchor studs, a face place and a stock ring is shown, but other embodiments may utilize other geometries or connections to sufficiently allow a cable or other connection system to pull module 100 tighter against module 200. In yet another embodiment, a module may be tightened to another module that it is not adjacent too by use of a longer cable or other connection. In this fashion, the two modules that are pulling tighter together will also tighten together intervening modules.

Figure 9:
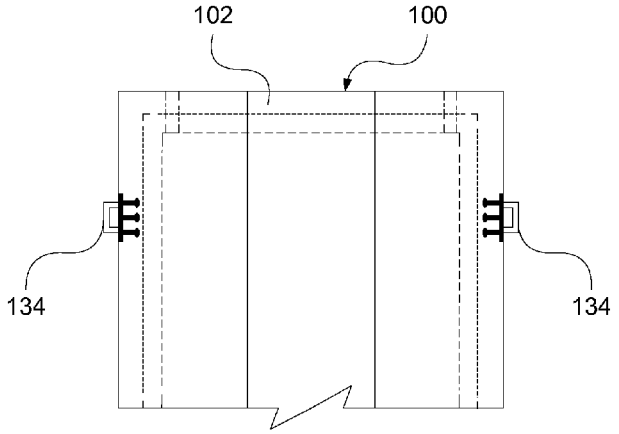
FIG. 9 is a top section view of an erosion control module showing a guide for coupling modules.
Figure 10:
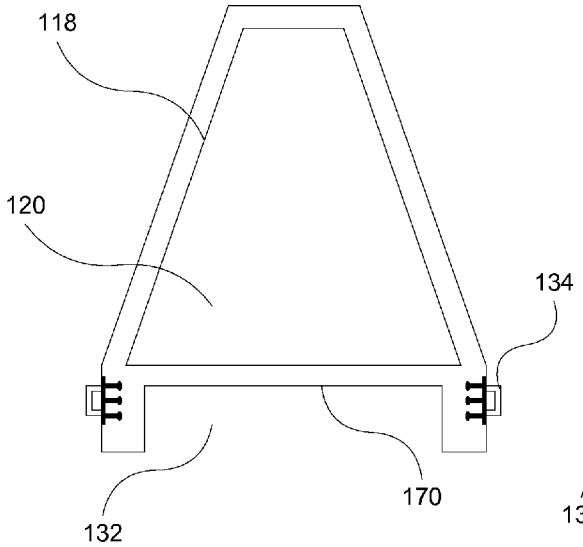
FIG. 10 is an end view of an erosion control module showing a guide for coupling modules.
Figure 11:
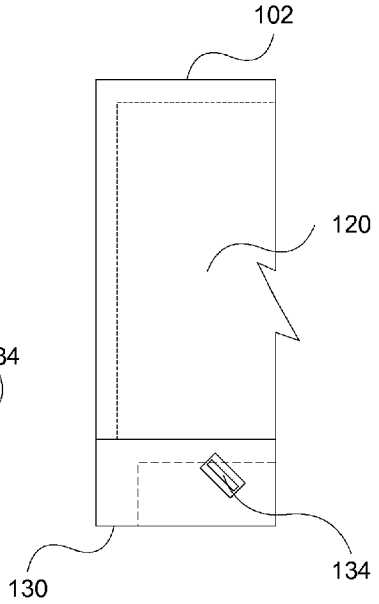
FIG. 11 is a side section view of an erosion control module showing a guide for coupling modules.

FIG. 9 is a top section view of an erosion control module showing a guide 134 for coupling modules. In some embodiments, the guide 134 may be constructed similarly or the same as anchor 136 but just oriented differently on the module. In a preferred embodiment, the angle of the stock ring should bisect the interior angle of the cable 140 between an anchor and a cable clamp, but other embodiments are not so limited and may have the guide section placed at another angle. FIG. 11 is a side section view of an erosion control module showing an example angle of guide 134 in relation to module 100.

Figure 12:
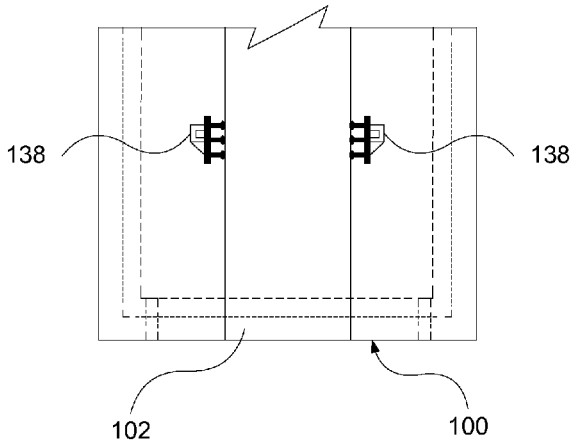
FIG. 12 is a top section view of an erosion control module showing a clamp for coupling modules.
Figure 13:
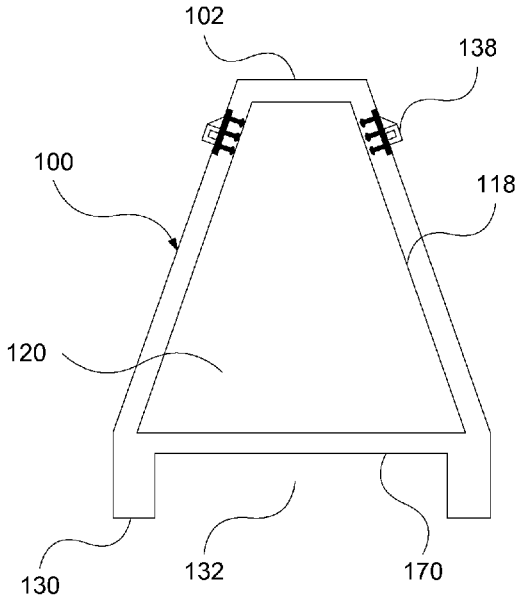
FIG. 13 is an end view of an erosion control module showing a clamp for coupling modules.
Figure 14:
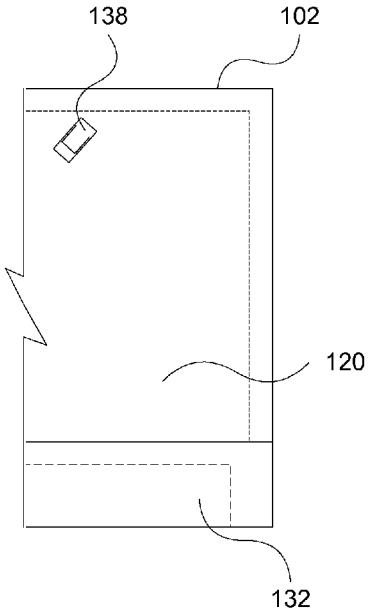
FIG. 14 is a side section view of an erosion control module showing a clamp for coupling modules.

FIGS. 12-14 are a top section view, an end view and a side section view of an erosion control module 100 showing a clamp 138 for coupling modules. In alternate embodiments, clamp 138 may be placed in a different location on module 100. This would allow different placement of winch 250, different interior angles of cable 140 formed between anchor 136, guide 234 and clamp 138. For example, if the angled side walls had a different geometry, it may be advantageous to have multiple guides or different placements of anchors, guides or clamps.

Referring back to FIG. 2, module 200 is shown with winch 250 which receives the cable and can tighten the cable and secure module 100 to module 200 whereby the cable 140 can then be clamped with cable clamp 238. A lightweight module and buoyancy compensated system therefore allows for each unit to be floated or helicoptered in, connected by cable to a modular train and secured in place and then the cables can be drawn tight bringing the modular being placed firm and secure next to the unit already secured.

By way of example, if a helicopter is used to place a module, the cable 140 can have upwards of 10 feet of slack which can be connected to the next module as the first module is lowered by the helicopter. The cable can then be tightened as the helicopter lowers the unit. As the cable 140 is tightened, the rubber bumper 180 will become depressed and will seal a lower portion of the modules together. Additionally, this cable and rubber bumper connection allows a small opening above the rubber bumper between the two modules that will allow marine animals from either side of the system to pass through the barrier and also equalize the water level on each side of the train of modules.

It will further be understood that the modules described herein are exemplary in nature, and that these specific embodiments or examples are not to be considered in a limiting sense, because numerous variations are possible.

The subject matter of the present disclosure includes all novel and nonobvious combinations and subcombinations of the various processes, systems and configurations, and other features, functions, acts, and/or properties disclosed herein, as well as any and all equivalents thereof.

The invention claimed is:

1. A buoyancy compensated erosion control module, comprising:

a shell having at least one wall oriented at an off-vertical angle;

a substantially enclosed inner cavity, the inner cavity at least partially filled with a foam core;

a perimeter footing at the bottom of the shell, the perimeter footing having a lower cavity that is open on the bottom;

at least one vertical pile sleeve and at least one battered pile sleeve; and at least one connector to couple the module to a second module, wherein the erosion control module is buoyancy compensated by the inner cavity and foam core.

2. The buoyancy compensated erosion control module of claim 1, further comprising a vertical pin pile placed within the vertical pile sleeve and a battered pin pile placed within the battered pin pile sleeve, wherein the module is held in place by a combination of the vertical pin pile, the battered pin pile and the perimeter footing at the bottom of the shell.

3. The buoyancy compensated erosion control module of claim 1, wherein the shell is constructed from concrete.

4. The buoyancy compensated erosion control module of claim 3, wherein the concrete includes a welded wire fabric reinforcement placed within walls of the shell.

5. The buoyancy compensated erosion control module of claim 3, wherein the concrete is made with type V cement.

6. The buoyancy compensated erosion control module of claim 1, further comprising a rubber bumper on an end to provide a deformable barrier with another module.

7. The buoyancy compensated erosion control module of claim 1, wherein the buoyancy compensated erosion control module is a first module in a system and the connector is an anchor, the system further comprising:

a second module having a guide and a clamp; and a cable connected to the anchor of the first module and through the guide and clamp of the second module, wherein the modules are secured in an adjacent position to each other by the cable connecting the anchor of the first module to the guide and clamp of the second module.

8. The system of claim 7 further comprising a winch to attach to one of the first module or the second module, wherein the winch is configured to tighten the cable connection the first module and the second module.

9. The buoyancy compensated erosion control module of claim 1, wherein the buoyancy compensated erosion control module is a first module in a system and the connector is an anchor, the system further comprising:

a plurality of modules, each having at least one guide, at least one anchor and at least one clamp; and a cable connected to the anchor of the first module and through the guide and clamp of a second module, wherein the first and second modules are secured in an adjacent position to each other by the cable connecting the anchor of the first module to the guide and clamp of the second module, and wherein the second module is connected to a third module by a second cable.

10. A method of constructing a buoyancy compensated erosion control system, the method comprising:

placing a first module in an erosion protection location, the first module having a shell having at least one wall oriented at an off-vertical angle, a substantially enclosed inner cavity, the inner cavity at least partially filled with a foam core, a perimeter footing at the bottom of the shell, the perimeter footing having a lower cavity that is open on the bottom, at least one vertical pile sleeve and at least one battered pile sleeve, and at least one connector to couple the module to a second module, wherein the erosion control module is buoyancy compensated by the inner cavity and foam core;

placing a second module adjacent to the first module, the second module having a shell having at least one wall oriented at an off-vertical angle, a substantially enclosed inner cavity, the inner cavity at least partially filled with a foam core, a perimeter footing at the bottom of the shell, the perimeter footing having a lower cavity that is open on the bottom, at least one vertical pile sleeve and at least one battered pile sleeve, and at least one connector to couple the module to the first module, wherein erosion control module is buoyancy compensated by the inner cavity and foam core;

connecting a cable to the connector on the first module and to the connector on the second module; and winching the first module and second module into a secure adjacent position to create a buoyancy compensated erosion control system.

11. The method of claim 10, further comprising placing a vertical pin pile within the vertical pile sleeve of the first module and a battered pin pile within the battered pin pile sleeve of the first module, wherein the first module is held in place by a combination of the vertical pin pile, the battered pin pile and the perimeter footing at the bottom of the shell.

12. The method of claim 11, placing a second vertical pin pile within the vertical pile sleeve of the second module and a second battered pin pile within the battered pin pile sleeve of the second module, wherein the second module is held in place by a combination of the second vertical pin pile, the second battered pin pile and the perimeter footing at the bottom of the shell of the second module.

* * * * *